United States Patent [19]

Usher

[11] Patent Number: 4,751,627

[45] Date of Patent: Jun. 14, 1988

[54] TUBULAR LIGHTING SYSTEM

[76] Inventor: Scott D. Usher, 98 Copley Ave., Teaneck, N.J. 07666

[21] Appl. No.: 45,689

[22] Filed: May 1, 1987

[51] Int. Cl.[4] ..... F21M 3/18; F21S 1/02

[52] U.S. Cl. ..... 362/421; 362/425; 362/404; 362/226; 362/372; 362/250

[58] Field of Search ..... 362/239, 250, 288, 306, 362/365, 368, 372, 404, 147, 287, 249, 367, 406, 419, 421, 425, 427, 428, 429, 226

[56] References Cited

U.S. PATENT DOCUMENTS

| | | | |
|---|---|---|---|
| 2,782,295 | 2/1957 | Schwenkler | 362/365 |
| 2,790,894 | 4/1957 | Zingone | 362/429 |
| 3,003,055 | 10/1961 | Liberman | 362/249 |
| 3,155,322 | 11/1964 | Akita et al. | 362/249 |
| 3,351,750 | 11/1967 | Hall | 362/250 |
| 4,025,777 | 5/1977 | Hayakawa | 362/250 |
| 4,360,279 | 12/1981 | Cohen | 362/428 |
| 4,360,859 | 11/1982 | Ziaylek, Jr. | 362/306 |
| 4,420,798 | 12/1983 | Henst et al. | 362/226 |
| 4,437,142 | 3/1984 | Donato et al. | 362/297 |
| 4,482,944 | 11/1984 | Roossine et al. | 362/250 |
| 4,499,528 | 2/1985 | Howlitzki | 362/250 |

FOREIGN PATENT DOCUMENTS

| | | | |
|---|---|---|---|
| 0175659 | 3/1986 | European Pat. Off. | 362/294 |

*Primary Examiner*—Ira S. Lazarus
*Assistant Examiner*—Sue Hagarman
*Attorney, Agent, or Firm*—Samuelson & Jacob

[57] ABSTRACT

A lighting system includes a plurality of elongate tubular members joined together in a selected array, each tubular member carrying lamp assemblies therein and aimed laterally through apertures in the wall of the tubular member, the lamp assemblies being captured within the tubular members by coupling means enabling rotation of the lamp assemblies for aiming purposes and selective insertion and withdrawal of the lamp assemblies through corresponding apertures for removal and replacement of expended lamps.

20 Claims, 6 Drawing Sheets

TUBULAR LIGHTING SYSTEM

The present invention relates generally to lighting systems and pertains, more specifically, to a tubular lighting system for providing both functional and decorative lighting in a wide variety of installations.

Throughout the years, the demand for lamps and light fixtures has inspired creativity in both artistic and technical endeavors to fulfill aesthetic as well as functional requirements for lighting. As a result, a wide variety of lighting devices has been made available, enabling almost limitless choices when selecting a lighting system for a particular installation. And yet, new lighting components continue to be made available, inspiring the creation of still further lighting systems to satisfy the ever-present need for unique, yet functional lighting effects.

The lighting system of the present invention was inspired primarily by the commercial availability of relatively small, high-intensity, low-voltage lamps, such as those designated in the trade as MR-16 lamps. However, it will become apparent that the structural arrangements and aesthetic effects of the lighting system of the present invention are available for use in connection with other types of lamps as well. Accordingly, the present invention provides several objects and advantages, some of which may be summarized as follows: Exceptional versatility enabling an almost unlimited number of unique aesthetic arrangements tailored to any one of a wide variety of installations; ease of installation utilizing simplified techniques and requiring no extraordinary skills or special tools; quick and ready aiming of lamp assemblies for attaining the desired distribution of light in a particular installation; simplified removal and replacement of expended lamps; relatively inexpensive construction utilizing a minimum number of parts of simplified configuration for economical manufacture and assembly; and a high degree of structural integrity for a long service life.

The above objects and advantages, as well as further objects and advantages, are attained by the present invention which may be described briefly as a lighting system for use in connection with an adjacent structure and having at least one lamp for providing a light source, the lighting system comprising: at least one elongate tubular member extending in a longitudinal direction between opposite ends, the tubular member including an interior, a tubular wall and at least one aperture in the tubular wall intermediate the opposite ends; a lamp holder for holding the lamp in assembed relationship therewith in a lamp assembly, the relative dimensions of the lamp assembly and the aperture being such that the lamp assembly may be passed laterally through the aperture into and out of the interior of the tubular member to be enclosed selectively within the tubular member; mounting means within the interior of the tubular member, adjacent the aperture, for locating the lamp holder within the interior of the tubular member in juxtaposition with the aperture such that light from the lamp assembly will be directed in a lateral direction through the aperture; and coupling means on the mounting means for selectively coupling the lamp holder with the mounting means in response to insertion of the lamp assembly laterally through the aperture into the interior of the tubular member and for selectively uncoupling the lamp holder from the mounting means in response to withdrawal of the lamp assembly laterally through the aperture out of the interior of the tubular member.

The invention will be understood more fully, while still further objects and advantages will become apparent, in the following detailed description of preferred embodiments thereof illustrated in the accompanying drawing, wherein.

Figure 1:
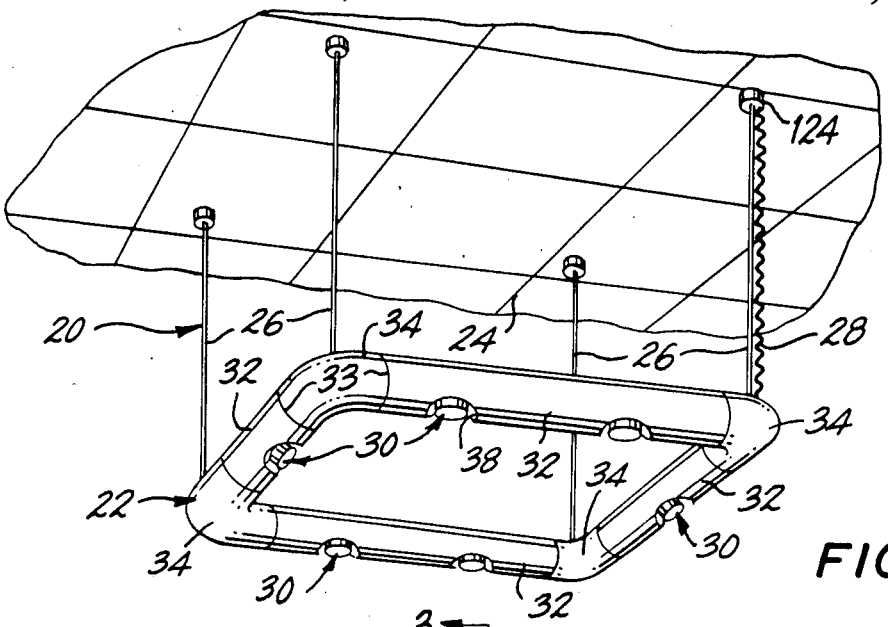
FIG. 1 is a pictorial view of a lighting installation utilizing a lighting system constructed in accordance with the invention.

Referring now to the drawing, and especially to FIG. 1 thereof, a lighting installation 20 utilizes a lighting system constructed in accordance with the invention and shown in the form of lighting fixture 22 suspended from an adjacent structure, illustrated as a ceiling 24, at the site of the installation 20. Suspension cables 26 are attached to the ceiling 24 and drop downwardly to support lighting fixture 22. A power cable 28 also extends downwardly from the ceiling 24 to the lighting fixture 22 to supply power to the lighting fixture. Lighting fixture 22 includes a plurality of lamp assemblies 30 carried by tubular members 32 arranged in a generally rectangular array and joined together at adjacent ends 33 by sleeve elements in the form of 90° elbows 34 at each corner of the rectangular array. The lamp assemblies 30 are aimed so as to distribute light to the surrounding vicinity, in a manner which will be described in further detail below.

Figure 2:
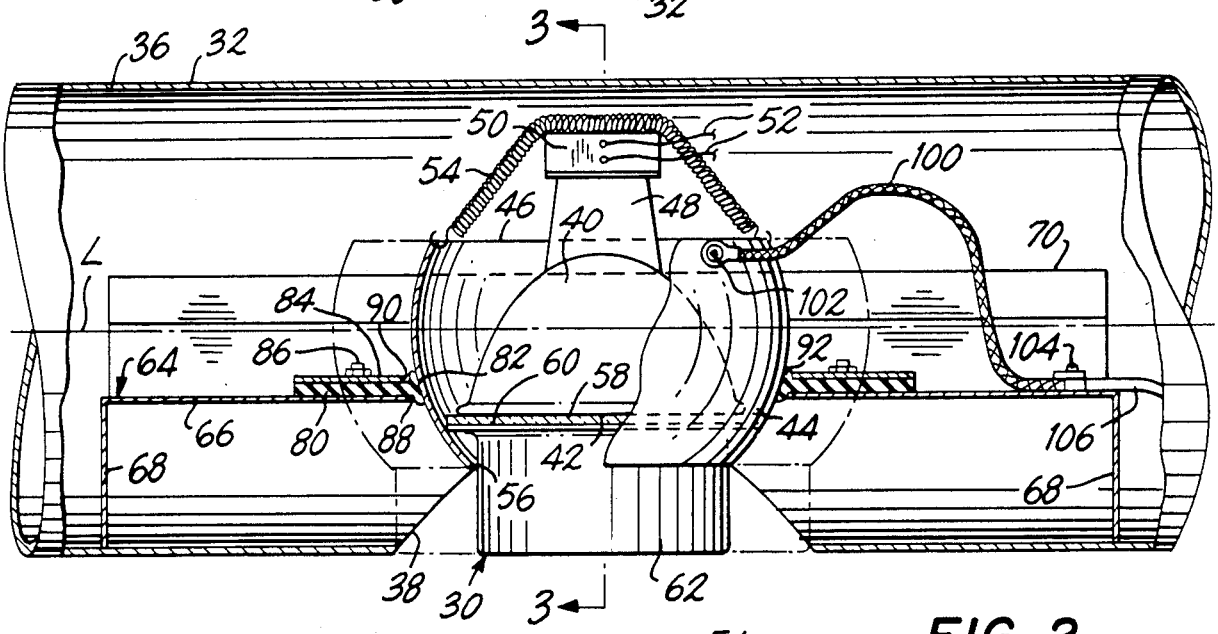
FIG. 2 is a enlarged fragmentary view of a portion of the lighting system, broken away to show internal details.
Figure 3:
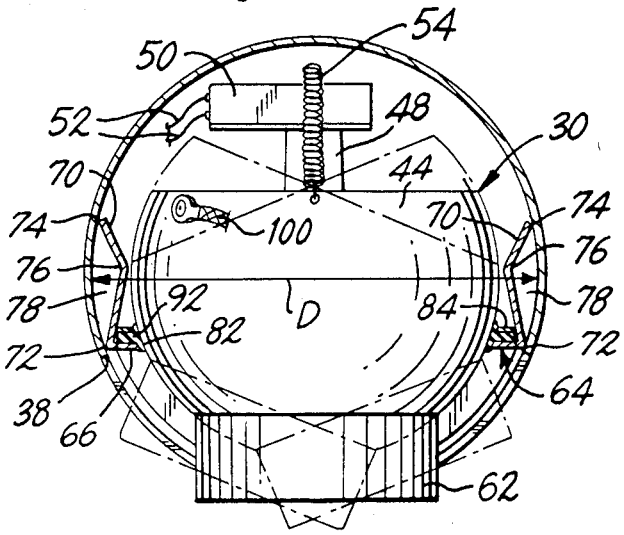
FIG. 3 is a cross-sectional view taken along line 3—3 of FIG. 2.

Turning now to FIGS. 2 and 3, tubular members 32 each include an elongate generally cylindrical wall 36 extending along a longitudinal axis L which is straight and oriented in a horizontal direction. An aperture 38 extends through the wall 36 at the location of each lamp assembly 30. Lamp assembly 30 includes a lamp 40, here shown in the form of a commercially available high-intensity, low-voltage lamp, designated in the trade as an MR-16 lamp, having a sealed envelope which includes within the envelope the filament of the lamp and a reflector for directing light through the face 42 of the lamp 40. Lamp 40 is placed within a lamp holder shown in the form of a semi-spherical housing 44 having an opening 46 at the top thereof through which the neck 48 of the lamp 40 extends to be connected to a lamp socket 50 which, in turn, is connected to leads 52. Leads 52 are a part of a power distribution circuit which includes a transformer (not shown) located elsewhere in the tubular member 32, and connected between the leads 52 and the power cable 28. A lamp-retaining spring 54 is passed over lamp socket 50 and biases the lamp socket 50 and lamp 40 downwardly toward a lower opening 56 in the housing 44. Interposed between the face 42 of lamp 40 and the lower opening 56 are a transparent plate 58, preferably constructed of safety glass, and the flange 60 of a cylindrical snoot 62 which extends downwardly in a lateral direction to pass through aperture 38 and reduces glare from the lamp 40.

Lamp assembly 30 is mounted within the interior of tubular member 32 by means of a carrier member 64 placed within the interior of tubular member 32 and including a longitudinally extending platform 66 having depending end webs 68 and opposite side rails 70. Preferably, carrier member 64 is constructed of a resiliently flexible sheet material, such as sheet steel, and side rails 70 are unitary with platform 66. Platform 66 rests upon wall 36 of tubular member 32 below the diameter D of tubular member 32, at 72, and side rails 70 are bent upwardly and extend outwardly to be resiliently biased against wall 36 of tubular member 32, at 74 above the diameter D. In this manner, side rails 70 serve as securing means by which carrier member 64 is secured against altitudinal upward and downward movement and resists longitudinal movement along the length of tubular member 32. In addition, side rails 70 are bent inwardly at 76 to establish passages 78 which serve as wire ways for wires (not shown) which distribute power to lamps 40, or to any other electrically operated device mounted in the vicinity of installation 20.

Figure 4:
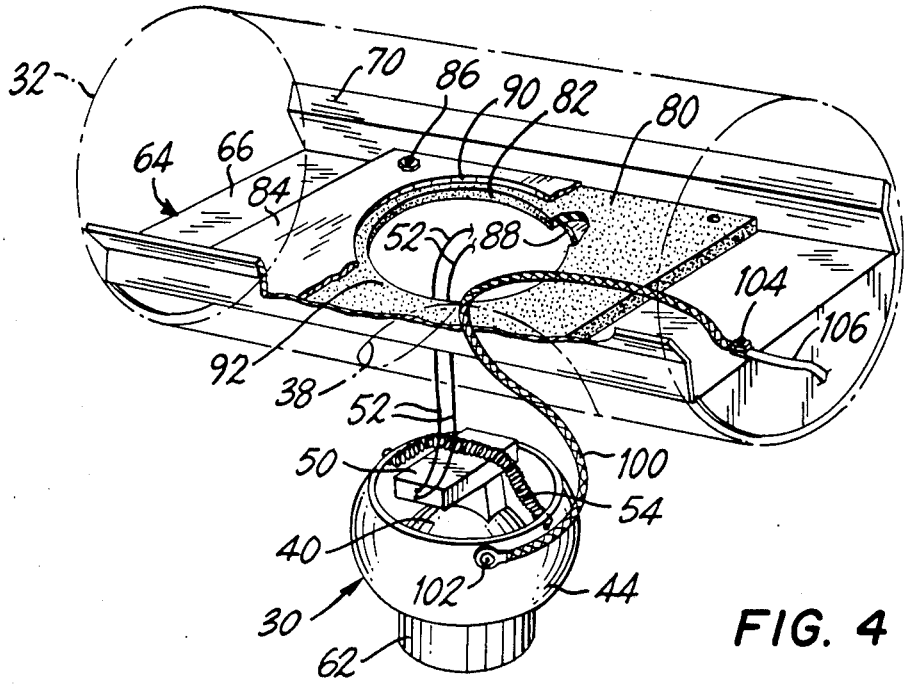
FIG. 4 is a perspective view of internal component parts of the lighting system.

Referring now to FIG. 4, as well as to FIGS. 2 and 3, lamp assembly 30 is coupled to carrier member 64 by means of a resilient retaining member 80, shown in the form of a sheet of resilient material, such as an elastomeric material, having a resiliently dilatable opening 82. The elastomeric material preferably is a silicone rubber which provides the required degree of heat resistance while maintaining the desired resiliency. Resilient retaining member 80 is clamped between platform 66 and a securing plate 84, by means of fasteners 86. Platform 66 has an aperture 88, and securing plate 84 has an aperture 90, and both apertures 88 and 90 are coaxial with opening 82 and have a diameter greater than the diameter of opening 82 so that a resilient lip 92 surrounds opening 82 in resilient retaining member 80. The diameter of opening 82 is less than the diameter of housing 44 of the lamp holder so that the housing 44 is gripped within lip 92, as shown in FIGS. 2 and 3, with snoot 62 projecting downwardly into aperture 38.

For aiming purposes, lamp assembly 30 is movable relative to tubular member 32 in two different modes. First, housing 44 may be swiveled within resilient retaining member 80 by grasping snoot 62 and rotating housing 44 relative to resilient retaining member 80, and platform 66. The frictional coupling between the lip 92 and the housing 44 maintains the housing 44 at a desired aimed position, some of which positions are shown in phantom in FIG. 3. Second, housing 44 may be moved longitudinally relative to tubular member 32 by sliding carrier member 64 longitudinally toward either end of tubular member 32, within the limits set by the engagement of snoot 62 with the perimeter of aperture 38, as shown in phantom in FIG. 2. The resiliency of side rails 70, while resisting inadvertent longitudinal movement of carrier member 64, will permit such deliberate sliding movement. End webs 68, which move with carrier member 64, serve as light shrouds.

Should it become necessary to remove and replace an expended lamp 40, all that is required is that snoot 62 be grasped and pulled downwardly through aperture 38. Opening 82 will be dilated to pass housing 44 downwardly through the resilient retaining member 80 to be released from the carrier member 64. Aperture 38 is large enough to permit the passage of housing 44 through the aperture 38 and out of the tubular member 32, as shown in FIG. 4. For safety purposes, housing 44 is tethered to carrier member 64 by a cable 100 fastened to housing 44 at 102 and to carrier member 64 at 104, so that lamp assembly 30 cannot inadvertently fall from the lighting fixture 22. Cable 100 is a conductor and is connected at 104 to a ground wire 106. When the lamp assembly 30 is removed from tubular member 32, lamp retaining spring 54 and lamp socket 50 are accessible for removal and replacement of lamp 40. Once the lamp 40 is replaced, the lamp assembly 30 merely is re-inserted through aperture 38, opening 82 being dilated to pass housing 44 upwardly into the retained position shown in FIGS. 2 and 3.

Figure 5:
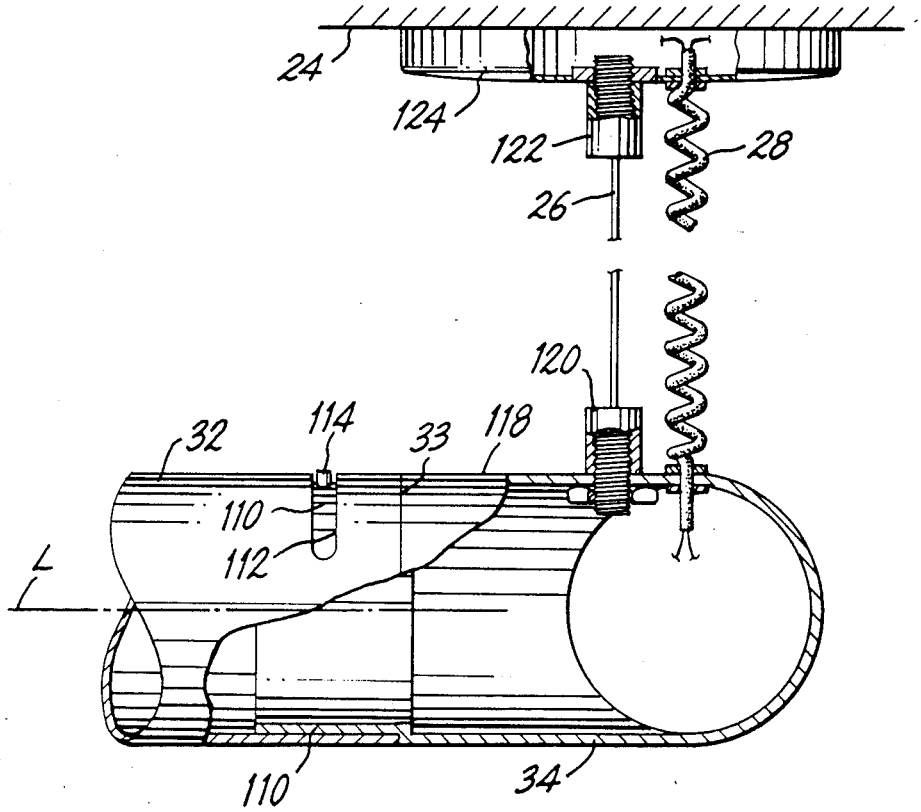
FIG. 5 is an enlarged fragmentary view of another portion of the lighting system, broken away to show internal details.

Turning to FIG. 5, as well as to FIG. 1, each end 33 of a tubular member 32 is telescopically engaged with a sleeve portion 110 of an elbow 34 to couple together adjacent ends 33 within light fixture 22. A circumferentially-extending slot 112 of limited circumferential extent is located near end 33 of tubular member 32 and a pin 114 passes through slot 112 and is threaded into sleeve portion 110. In this manner, tubular member 32 is secured longitudinally relative to elbow 34, with the outer surface 116 of the tubular member 32 flush with the outer surface 118 of elbow 34. However, further aiming of the lamp assemblies 30 carried by tubular member 32 is accomplished by rotating tubular member 32 about axis L relative to elbow 34, within the limits defined by the circumferential length of slot 112. The frictional engagement between the sleeve portion 110 of elbow 34 and tubular member 32 secures the adjustment. Suspension cables 26 extend between a first cable connector 120 secured to the elbow 34, and a second cable connector 122 secured to a canopy 124 affixed to the ceiling 24. Either one or both of the cable connectors 120 and 122 may be of the adjustable type to facilitate the adjustment of the location of the elbow 34 relative to the ceiling 24, and the leveling of light fixture 22. Power cable 28 extends between canopy 124 and elbow 34 in a manner now well-known in the art of lighting fixtures. Alternately, rigid tubular mounts can be utilized in place of the suspension cables and a power cable can be routed through such tubular mounts in a conventional manner.

Figure 6:
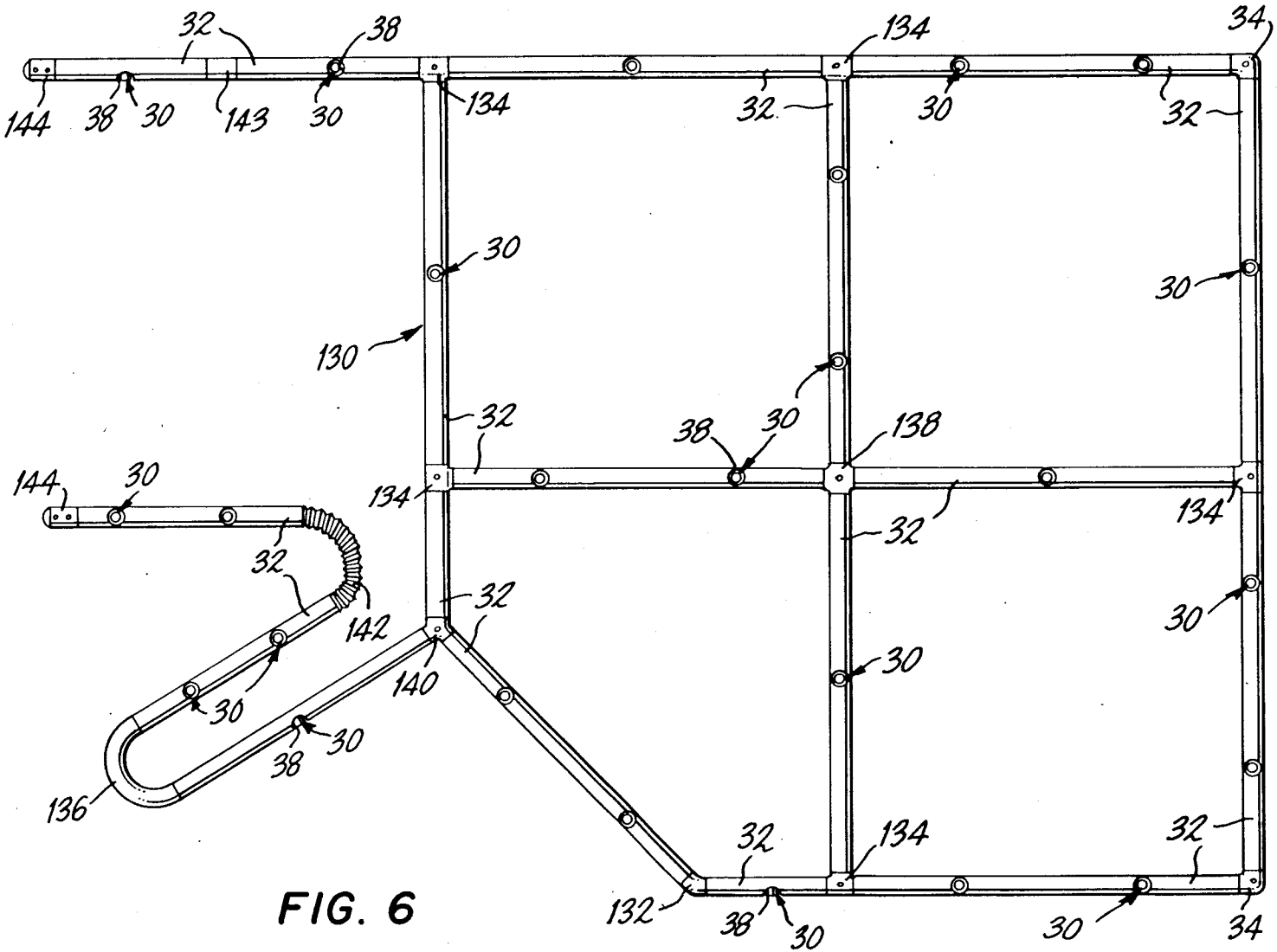
FIG. 6 is a plan view of another lighting installation utilizing the lighting system of the invention.

Tubular members 32 may be arranged in any one of a wide variety of patterns and arrays to accommodate a particular lighting requirement, as well as to attain a desired aesthetic effect. Thus, as seen in FIG. 6, a plurality of tubular members 32 have been assembled with joining elements of various configurations to establish one exemplary array 130. In addition to joining elements in the form of 90° elbows 34, array 130 includes a 45° elbow 132, T-shaped connectors 134, U-shaped connector 136, an X-shaped connector 138 and even a Y-shaped connector 140. Other connector configurations are feasible, including a universal bellows-type connector 142 and a straight connector 143. The joining elements also serve as wiring compartments for electrically connecting together the electrical elements within the tubular members 32. End caps 144 close the free ends of tubular members 32 to complete the array 130. Although most of the tubular members 32 are illustrated with two lamp assemblies 30 mounted in each tubular member 32, it will be apparent that the number of lamp assemblies 30 in each tubular member 32 may be varied. Thus, the system of the present invention enables an almost infinite variety of patterns and arrays in a lighting installation.

Figure 7:
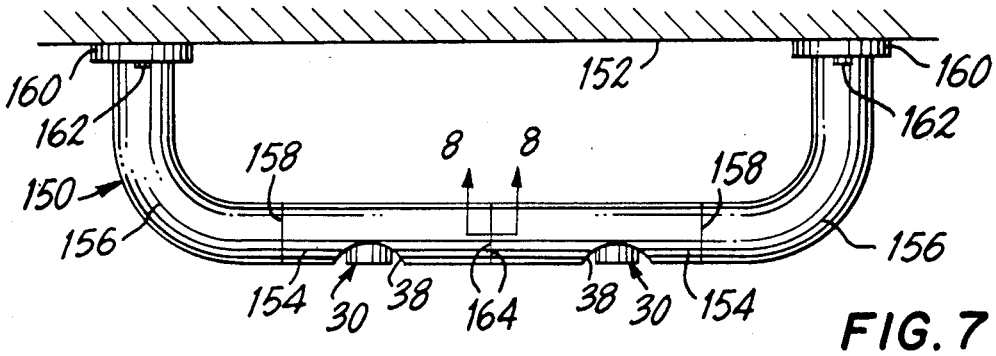
FIG. 7 is a plan view of still another lighting installation utilizing the lighting system of the invention.
Figure 8:
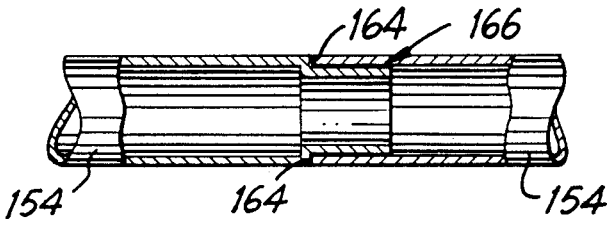
FIG. 8 is an enlarged cross-sectional view taken along line 8—8 of FIG. 7.

Another embodiment of the lighting system of the present invention is illustrated in FIGS. 7 and 8, in the form of lighting fixture 150 attached to an adjacent structure in the form of a vertical wall 152. Lighting fixture 150 includes two horizontally oriented tandem tubular members 154, each of which includes one aperture 38 and carries one lamp assembly 30 in precisely the same manner as the lamp assemblies are carried in the above-described tubular members 32. Elbows 156 are joined with the opposite ends 158 of the tubular members 154 in the manner described in connection with elbows 34, however, elbows 156 each include an integral flange 160 which can be affixed to wall 152 by fasteners 162 to secure the fixture 150 to the wall 152. The confronting ends 164 of tubular members 154 are telescopically coupled together, as seen in FIG. 8, by a ferrule-like coupling arrangement 166 which holds the tubular members 154 together, but permits relative turning about the longitudinal axis of the tubular members. Thus, each lamp assembly 30 may be aimed entirely independent of the other lamp assembly 30.

Figure 9:
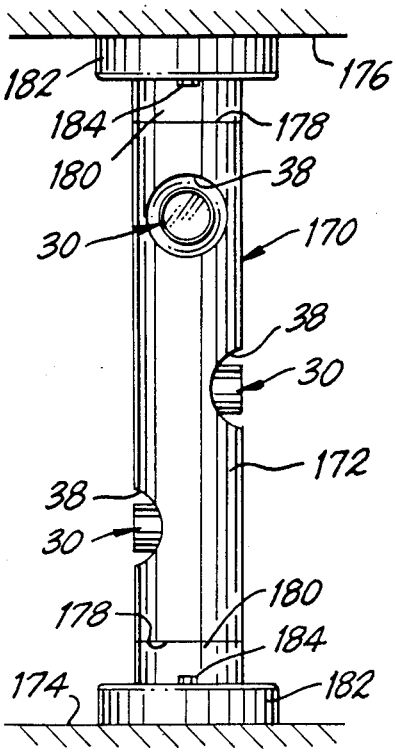
FIG. 9 is an elevational view of yet another lighting installation utilizing a lighting system of the invention.

In the embodiment of FIG. 9, a lighting fixture 170 includes a tubular member 172 aligned vertically between a floor 174 and a ceiling 176. The opposite ends 178 of the tubular member 172 are joined with end fittings 180 in a manner similar to the coupling between tubular members 32 and elbows 34 above; however, end fittings 180 include integral flanges 182 secured to the adjacent structure by fasteners 184. The tubular member 172 includes apertures 38 and carries lamp assemblies 30 in the manner described in connection with tubular members 32. In this instance, the apertures 38 are located at different circumferential positions around the tubular member 172.

Figure 10:
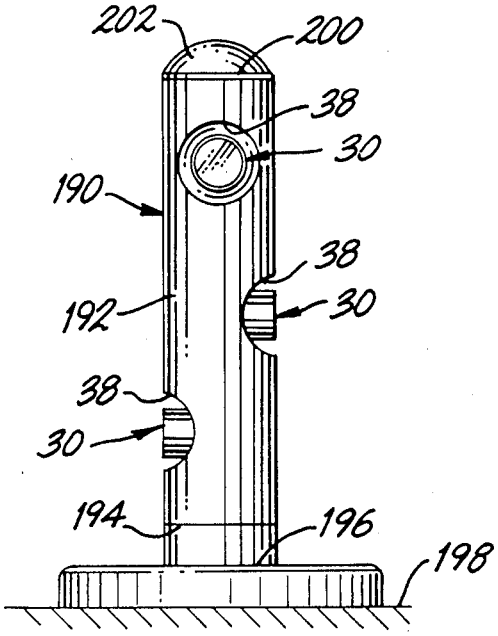
FIG. 10 is an elevational view of another lighting installation utilizing a lighting system of the invention.

A free-standing version is shown in FIG. 10 wherein there is illustrated a lighting fixture 190 having a vertically-oriented tubular member 192 the lower end 194 of of which is fitted into a base 196 which rests upon a floor 198. The upper end 200 is capped with an end cap 202. A plurality of apertures 38 are spaced circumferentially around the periphery of the tubular member 192, as well as longitudinally along the tubular member 192. Lamp assemblies 30 are carried by tubular member 192 in the same manner as described above in connection with tubular member 32.

Figure 11:
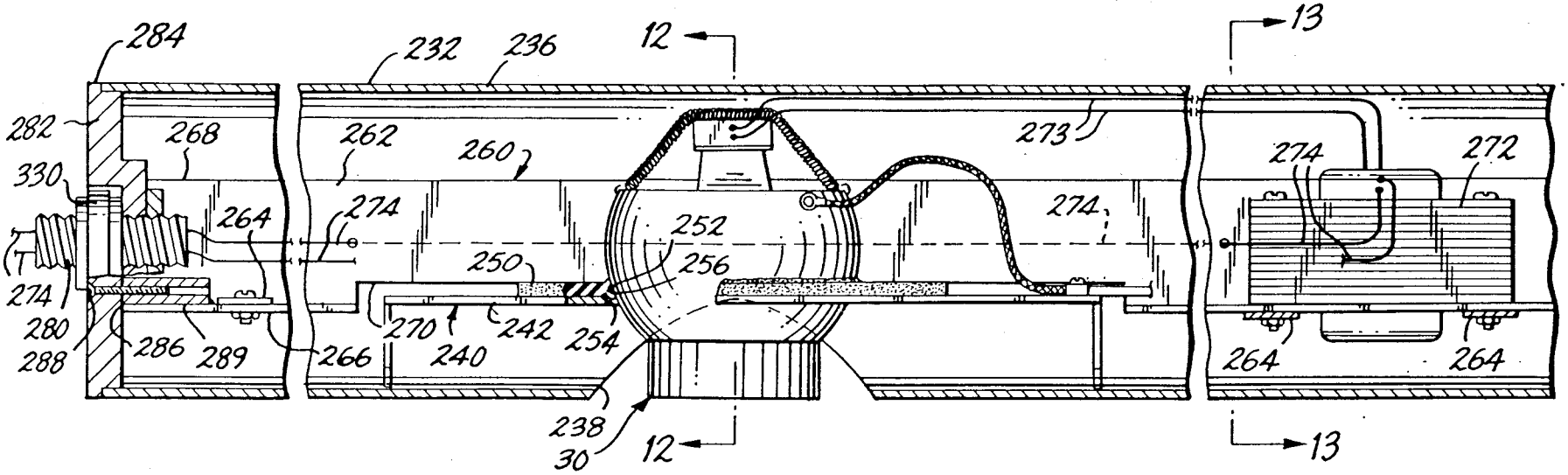
FIG. 11 is a fragmentary view similar to FIG. 2, but showing a further embodiment of the invention.
Figure 13:
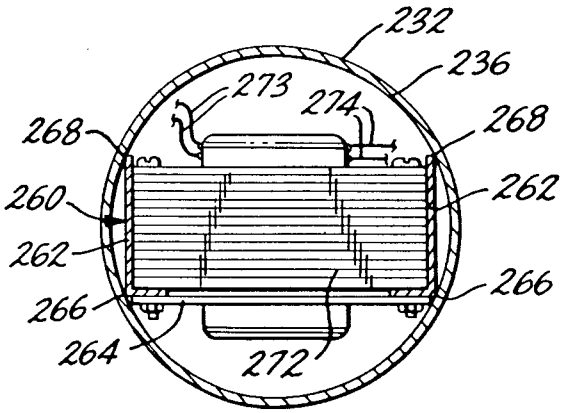
FIG. 13 is a cross-sectional view taken along line 13—13 of FIG. 11.
Figure 12:
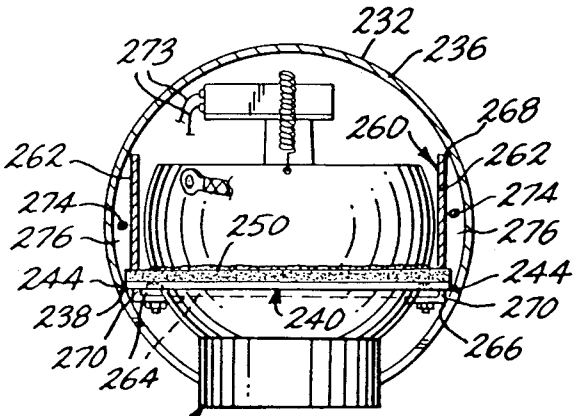
FIG. 12 is a cross-sectional view taken along line 12—12 of FIG. 11.

Referring now to FIGS. 11, 12 and 13, another embodiment of the invention includes a tubular member 232 which is similar to tubular member 32 in that tubular member 232 has tubular wall 236 extending longitudinally between opposite ends and a plurality of lamp assemblies 30 (only one is shown) are carried by the tubular member 232, each lamp assembly 30 being received through a corresponding aperture 238 extending laterally through the wall 236 and being mounted within the interior of tubular member 232 by means of a carrier member 240. In this instance, carrier member 240 includes a flat plate 242 having opposite longitudinal edges 244 which rest upon the inside of wall 236 of tubular member 232.

Lamp assembly 30 is coupled to carrier member 240 by means of a resilient retaining member 250 shown in the form of a sheet of silicone rubber secured to one face of plate 242, as by an adhesive. A resiliently dilatable opening 252 in retaining member 250 is coaxial with a slightly larger aperture 254 in plate 242 to establish a lip 256 around the opening 252 so that lamp assembly 30 is gripped within lip 256 by the resilient dilation of opening 252, in the manner described above in connection with the first-described embodiment.

In the present embodiment, a rail assembly 260 extends along the interior of the tubular member 232, from one end to the other, and includes a pair of laterally opposite rails 262 extending parallel to one another and fixed in laterally spaced arrangement by a plurality of longitudinally spaced apart cross-bars 264. Each rail 262 extends altitudinally between a lower edge 266 and an upper edge 268, the edges 266 and 268 engaging the wall 236 to secure the rail assembly 260 against altitudinal movement relative to the tubular member 232. Each rail 262 includes a notch 270 which straddles carrier member 240 longitudinally and has a longitudinal length greater than the corresponding length of plate 242. Retaining member 250 extends laterally along plate 242 to be interposed between the plate 242 and each rail 262, within each notch 270, and the frictional engagement between the material of the sheet of retaining member 250 and the rails 262 secure the carrier member 240 against inadvertent longitudinal movement. However, deliberate movement of plate 242, within the limits defined by the length of notches 270, is accomplished by grasping lamp assembly 30 and moving the lamp assembly 30 and carrier member 240 longitudinally, for accomplishing one mode of aiming of the lamp assembly 30. As before, lamp assembly 30 may be rotated within retaining member 250 for angular aiming.

Each lamp assembly 30 has a corresponding transformer 272 secured to rail assembly 260 and a pair of leads 273 connects the transformer 272 to a corresponding lamp assembly 30. The transformer 272 itself is powered by conductors 274 which extend along the rails 262, within wire ways 276 established between the rails 262 and the wall 236 of tubular member 232. The wire ways 276 can be utilized to route further conductors, as desired, to power any add-on electrical devices which may be utilized in connection with tubular members 232.

Figure 14:
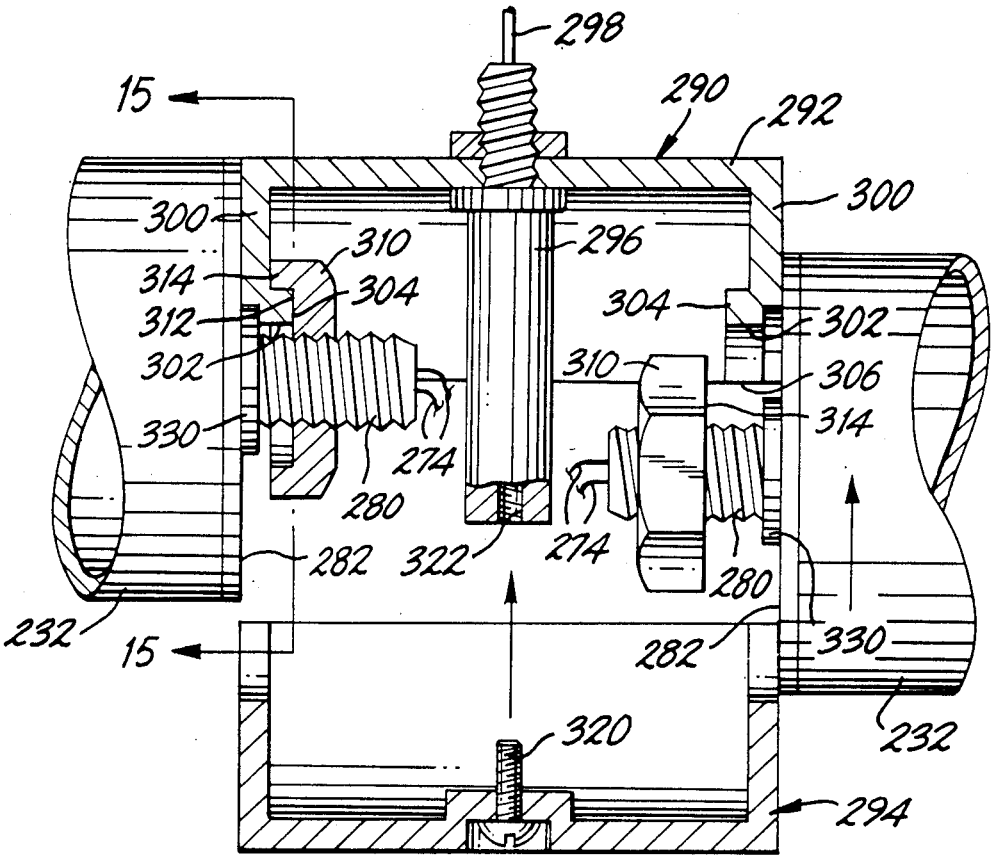
FIG. 14 is a partially exploded fragmentary longitudinal cross-sectional view showing another portion of the embodiment of FIG. 11.
Figure 15:
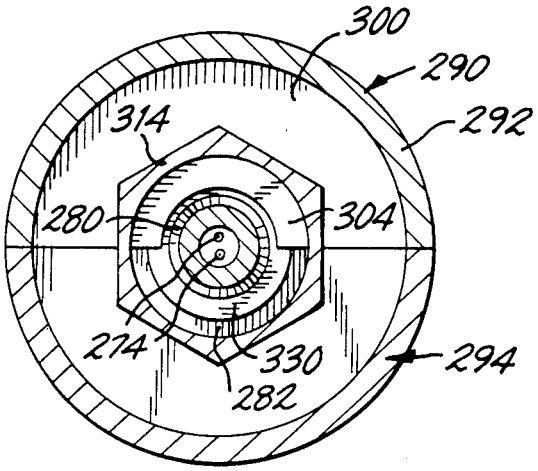
FIG. 15 is a cross-sectional view taken along line 15—15 of FIG. 14.

Conductors 274 pass through a threaded nipple 280 secured within an end plate 282 seated within the end 284 of tubular member 232 and attached to the end 286 of rail assembly 260, as by screws 288 threaded into fittings 289 affixed to rail assembly 260 at end 286. Nipple 280 projects longitudinally beyond end plate 282 to enable joining of the tubular member 32 to a next adjacent tubular member 32, as illustrated in FIGS. 14 and 15, utilizing a sleeve element shown in the form of split sleeve 290. Split sleeve 290 includes an upper half 292 and a lower half 294 which together make up the cylindrical split sleeve 290 having an outer diameter matching the diameter of tubular members 232. Upper half 292 carries a fitting 296 which receives a suspension cable 298 for suspending split sleeve 290 from an adjacent structure at the installation site. Depending semi-circular end walls 300 of upper half 292 each have a semi-circular recess 302 and a concentric lip 304 along the lower edge 306 of the end wall 300. Nipple 280 carries a threaded retainer 310 having a circular groove 312 and a concentric cylindrical skirt 314 confronting end plate 282.

Installation of tubular member 232 is accomplished by first suspending upper half 292 of split sleeve 290 by means of suspension cable 298. Each tubular member 232 is then joined with upper half 292 juxtaposing end plate 282 with end wall 300, placing nipple 280 against lip 304 along recess 302. Threaded retainer 310 is then threaded along nipple 280 toward end plate 282 until lip 304 is engaged within groove 312 with skirt 314 placed over lip 304, thereby suspending tubular member 232 from upper half 292. Once both adjacent tubular members 232 are suspended from upper half 292, corresponding conductors 274 may be connected to one another and the split sleeve 290 is closed by moving lower half 294 upwardly into position and securing lower half 294 in place by means of a threaded fastener 320 carried by lower half 294 and threaded into a complementary threaded hole 322 in fitting 296. With lower half 294 secured in place, split sleeve 290 provides an aesthetically pleasing continuous cylindrical configuration along the joined tubular members 232 as well as a closed connector box for the conductors 274, and any further conductors which may be routed through tubular members 232. Nipple 280 includes a swing unit 330 which provides a swivel enabling relative rotation between each end wall 300 and a corresponding end plate 282 so that tubular members 232 can be rotated relative to upper half 292 for aiming purposes.

The several versions illustrated herein are but a small number of arrangements possible in lighting installations constructed in accordance with the invention. It will be seen that the present invention provides a system which enables a very wide variety of lighting installations, all of which exhibit a unique aesthetic quality, while providing for simplified construction, installation and maintenance.

It is to be understood that the above detailed description of embodiments of the invention is provided by way of example only. Various details of design and construction may be modified without departing from the true spirit and scope of the invention as set forth in the appended claims.

The embodiments of the invention in which an exclusive property or privilege is claimed are defined as follows:

1. A lighting system for use in connection with an adjacent structure and having at least one lamp for providing a light source, the lighting system comprising:

at least one elongate tubular member extending in a longitudinal direction between opposite ends, the tubular member including an interior, a tubular wall and at least one aperture in the tubular wall intermediate the opposite ends;

a lamp holder for holding the lamp in assembled relationship therewith in a lamp assembly, the relative dimensions of the lamp assembly and the aperture being such that the lamp assembly may be passed laterally through the aperture in directions into and out of the interior of the tubular member to be enclosed selectively within the tubular member and to be removed selectively from the tubular member;

mounting means within the interior of the tubular member, adjacent the aperture, for locating the lamp holder within the interior of the tubular member in juxtaposition with the aperture such that light from the lamp assembly will be directed in a lateral direction through the aperture; and coupling means on the mounting means for selectively coupling the lamp holder with the mounting means in response to insertion of the lamp assembly laterally through the aperture into the interior of the tubular member and for selectively uncoupling the lamp holder from the mounting means in response to withdrawal of the lamp assembly laterally through the aperture out of the interior of the tubular member, the coupling means including a coupling member juxtaposed with the aperture in the wall of the tubular member such that the lamp holder is coupled to the mounting means in response to movement of the lamp assembly laterally in the direction into the interior of the tubular member and said insertion of the lamp assembly laterally through the aperture into the interior of the tubular member will establish a retaining force tending to retain the lamp assembly within the interior of the tubular member, and will release the lamp holder in response to deliberate movement of the lamp holder laterally in the direction out of the interior of the tubular member to permit selective release of the lamp holder and removal of the lamp assembly from the tubular member.

2. The invention of claim 1 wherein:

the mounting means includes a carrier member placed within the interior of the tubular member adjacent the aperture in the wall of the tubular member; and the coupling member is carried by the carrier member and includes resilient means having a resiliently dilatable opening juxtaposed with the aperture in the wall of the tubular member for receiving the lamp holder to couple the lamp holder with the carrier member, the relative dimensions of the opening and the lamp holder being such that the opening will dilate resiliently in response to movement of the lamp assembly in the direction into the interior of the tubular member and insertion of the lamp holder into the opening to establish the retaining force tending to retain the lamp assembly within the interior of the tubular member, and will dilate resiliently in response to deliberate movement of the lamp holder laterally in the direction out of the interior of the tubular member to permit said selective release of the lamp holder and removal to the lamp assembly from the tubular member.

3. The invention of claim 2 wherein the lamp holder includes a generally semi-spherical housing having a diameter smaller than the aperture in the wall of the tubular member and greater than the resiliently dilatable opening in the resilient member such that the opening will dilate resiliently in response to insertion of the housing into the opening and retain the housing within the interior of the tubular member for rotation of the semi-spherical housing relative to the carrier member to selectively aim the lamp assembly relative to the tubular member.

4. The invention of claim 3 wherein the tubular member is generally cylindrical.

5. The invention of claim 1 wherein the tubular member is generally cylindrical.

6. The invention of claim 1 wherein the lighting system includes more than one said elongate tubular member and sleeve elements joining adjacent ends of corresponding tubular members to establish an array of tubular elements.

7. The invention of claim 6 wherein the sleeve elements are joined with the tubular members for rotation of the tubular members about the longitudinal direction to accomplish further aiming of the lamp assemblies carried within the tubular members.

8. The invention of claim 7 wherein the tubular members are generally cylindrical.

9. The invention of claim 6 wherein at least one sleeve element includes connector means for connecting the sleeve element to the adjacent structure.

10. The invention of claim 9 wherein the sleeve elements are joined with the tubular members for rotation of the tubular members about the longitudinal direction to accomplish further aiming of the lamp assemblies carried within the tubular members.

11. The invention of claim 10 wherein the tubular members are generally cylindrical.

12. A lighting system for use in connection with an adjacent structure and having at least one lamp for providing a light source, the lighting system comprising:

at least one elongate tubular member extending in a longitudinal direction between opposite ends, the tubular member including an interior, a tubular wall and at least one aperture in the tubular wall intermediate the opposite ends;

a lamp holder for holding the lamp in assembled relationship therewith in a lamp assembly, the relative dimensions of the lamp assembly and the aperture being such that the lamp assembly may be passed laterally through the aperture into and out of the interior of the tubular member to be enclosed selectively within the tubular member;

mounting means within the interior of the tubular member, adjacent the aperture, for locating the lamp holder within the interior of the tubular member in juxtaposition with the aperture such that light from the lamp assembly will be directed in a lateral direction through the aperture, the mounting means including a carrier member placed within the interior of the tubular member adjacent the aperture in the wall of the tubular member; and coupling means on the mounting means for selectively coupling the lamp holder with the mounting means in response to insertion of the lamp assembly laterally through the aperture into the interior of the tubular member and for selectively uncoupling the lamp holder from the mounting means in response to withdrawal of the lamp assembly laterally through the aperture out of the interior of the tubular member;

the mounting means including securing means for securing the mounting means against inadvertent movement within the interior of the tubular member, the securing means being slidable selectively along the longitudinal direction for enabling deliberate longitudinal movement of the carrier member within the interior of the tubular member for further aiming of the lamp assembly relative to the tubular member.

13. The invention of claim 12 wherein:

the coupling means includes a resilient member carried by the carrier member and having a resiliently dilatable opening juxtaposed with the aperture in the wall of the tubular member for receiving the lamp holder to couple the lamp holder with the carrier member.

14. The invention of claim 13 wherein the lamp holder includes a generally semi-spherical housing having a diameter smaller than the aperture in the wall of the tubular member and greater than the resilient member such that the opening will dilate resiliently in response to insertion of the housing into the opening and retain the housing within the interior of the tubular member for rotation of the semi-spherical housing relative to the carrier member to selectively aim the lamp assembly relative to the tubular member.

15. The invention of claim 14 wherein the tubular member is generally cylindrical.

16. The invention of claim 14 wherein the resilient member is constructed of an elastomeric material.

17. The invention of claim 16 wherein the elastomeric material is a silicone rubber.

18. A lighting system for use in connection with an adjacent structure and having at least one lamp for providing a light source, the lighting system comprising:

at least one elongate tubular member extending in a longitudinal direction between opposite ends, the tubular member including an interior, a tubular wall and at least one aperture in the tubular wall intermediate the opposite ends;

a lamp holder for holding the lamp in assembled relationship therewith in a lamp assembly, the relative dimensions of the lamp assembly and the aperture being such that the lamp assembly may be passed laterally through the aperture into and out of the interior of the tubular member to be enclosed selectively within the tubular member;

mounting means within the interior of the tubular member, adjacent the aperture, for locating the lamp holder within the interior of the tubular member in juxtaposition with the aperture such that light from the lamp assembly will be directed in a lateral direction through the aperture, the mounting means including a carrier member placed within the interior of the tubular member adjacent the aperture in the wall of the tubular member; and coupling means on the mounting means for selectively coupling the lamp holder with the mounting means in response to insertion of the lamp assembly laterally through the aperture into the interior of the tubular member and for selectively uncoupling the lamp holder from the mounting means in response to withdrawal of the lamp assembly laterally through the aperture out of the interior of the tubular member, the coupling means including a resilient member constructed of an elastomeric material and carried by the carrier member, the resilient member having a resiliently dilatable opening juxtaposed with the aperture in the wall of the tubular member for receiving the lamp holder to couple the lamp holder with the carrier member, the lamp holder including a generally semi-spherical housing having a diameter smaller than the aperture in the wall of the tubular member and greater than the resiliently dilatable opening in the resilient member such that the opening will dilate resiliently in response to insertion of the housing into the opening and retain the housing within the interior of the tubular member for rotation of the semi-spherical housing relative to the carrier member to selectively aim the lamp assembly relative to the tubular member.

19. The invention of claim 18 wherein the elastomeric material is a silicone rubber.

20. A lighting system for use in connection with an adjacent sturcture and having at least one lamp for providing a light source, the lighting system comprising:

at least one elongate tubular member extending in a longitudinal direction between opposite ends, the tubular member including an interior, a tubular wall and at least one aperture in the tubular wall intermediate the opposite ends;

a lamp holder for holding the lamp in assembled relationship therewith in a lamp assembly, the relative dimensions of the lamp assembly and the aperture being such that the lamp assembly may be passed laterally through the aperture into and out of the interior of the tubular member to be enclosed selectively within the tubular member;

mounting means within the interior of the tubular member, adjacent the aperture, for locating the lamp holder within the interior of the tubular member in juxtaposition with the aperture such that light from the lamp assembly will be directed in a lateral direction through the aperture, the mounting means including a carrier member placed within the interior of the tubular member adjacent the aperture in the wall of the tubular member; and coupling means on the mounting means for selectively coupling the lamp holder with the mounting means in response to insertion of the lamp assembly laterally through the aperture into the interior of the tubular member and for selectively uncoupling the lamp holder from the mounting means in response to withdrawal of the lamp assembly laterally through the aperture out of the interior of the tubular member, the coupling means including a resilient member constructed of an elastomeric material and carried by the carrier member, the resilient member having a resiliently dilatable opening juxtaposed with the aperture in the wall of the tubular member for receiving the lamp holder to couple the lamp holder with the carrier member, the lamp holder including a housing having a diameter smaller than the aperture in the wall of the tubular member and greater than the resiliently dilatable opening in the resilient member such that the opening will dilate resiliently in response to insertion of the housing into the opening and retain the housing within the interior of the tubular member.

* * * * *